United States Patent [19]

Sando et al.

[11] 4,397,162

[45] Aug. 9, 1983

[54] DEVICE FOR MEASURING AND CONTROLLING THE PH OF THE ATMOSPHERE IN A HIGH PRESSURE STEAMER

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 282,603

[22] Filed: Jul. 13, 1981

[30] Foreign Application Priority Data

Jul. 19, 1980 [JP] Japan ..... 55-99050

[51] Int. Cl.[3] ..... D06B 23/20

[52] U.S. Cl. ..... 68/5 E; 68/13 R; 68/18 C; 422/111

[58] Field of Search ..... 68/5 C, 5 D, 5 E, 13 R, 68/18 C; 34/43; 324/438; 204/195 R, 195 G; 422/111; 436/38, 50

[56] References Cited

U.S. PATENT DOCUMENTS

| | | | |
|---|---|---|---|
| 2,161,726 | 6/1939 | Sochor et al. | 68/5 D |
| 2,485,710 | 10/1949 | Derby | 68/5 D X |
| 3,158,444 | 11/1964 | Larson et al. | 436/38 |

FOREIGN PATENT DOCUMENTS

| | | | |
|---|---|---|---|
| 45-1946 | 1/1970 | Japan | 68/5 E |

*Primary Examiner*—Philip R. Coe

*Attorney, Agent, or Firm*—Toren, McGeady and Stanger

[57] ABSTRACT

A device for measuring and controlling the pH of the atmosphere in a high pressure steamer, comprising a condenser for taking out and condensing a part of steam from the interior of the high pressure steamer body successively, a pH-meter immersed in the solution condensed in the condenser, an indicator and a transducer which are to work in accordance with the signal from the said pH-meter, and a means for controlling the amount of a pH controlling solution to be supplied into the interior of the steamer body in accordance with the output of the said transducer.

1 Claim, 2 Drawing Figures

DEVICE FOR MEASURING AND CONTROLLING THE PH OF THE ATMOSPHERE IN A HIGH PRESSURE STEAMER

BACKGROUND OF THE INVENTION

The present invention relates to a device for measuring and controlling the pH of the atmosphere in a high pressure steamer to be applied for wet heat treating a textile product such as a cloth at an elevated pressure.

A high pressure steamer has been applied for pretreating or dyeing a long cloth produced commercially with high speed continuously. A high pressure steamer for such a use is provided with a seal mechanism, which is to allow the continuous pass of a cloth to be treated therethrough while maintaining the high pressure wet heat in the steamer body, respectively to the cloth inlet and the cloth outlet of the steamer body. Treatment of a long cloth, for instance scouring, bleaching and dyeing, can be done speedily and continuously by wet heat treating the cloth at a temperature, for instance, about 160° C. under pressure while transporting the cloth continuously through the steamer body.

However, in subjecting a cloth to such treatment as dyeing by using such a high pressure steamer, the atmosphere in the interior of the steamer body becomes frequently acidic due to the evaporation of acidic components contained in the dye solution, so that a uniform continuous dyeing of a cloth becomes impossible due to the fluctuation of pH in the atmosphere and there occur further such problems that the inner walls of the steamer body are corroded, but it has been impossible conventionally to measure and control the pH of the atmosphere in the interior of the steamer body during operation.

SUMMARY OF THE INVENTION

Under such circumstances, the present invention is to offer a device for measuring the pH of the atmosphere in a high pressure steamer during operation and controlling the pH thereof in accordance with the pH measured. The principle of the invention comprises to condense a part of steam in the steamer body successively for measuring the pH thereof and to supply an appropriate amount of a pH controlling solution into the interior of the steamer body in accordance with the pH of the condensed solution automatically.

Wet heat treatment of a long cloth can effectively and satisfactorily be done continuously by using a high pressure steamer provided with the present inventive device for measuring and controlling the pH of the atmosphere in the high pressure steamer, and the corrosion of the high pressure steamer can simultaneously prevented thereby.

DETAILED DESCRIPTION OF THE PREFERRED EMBODIMENTS

Figures 1, 2:
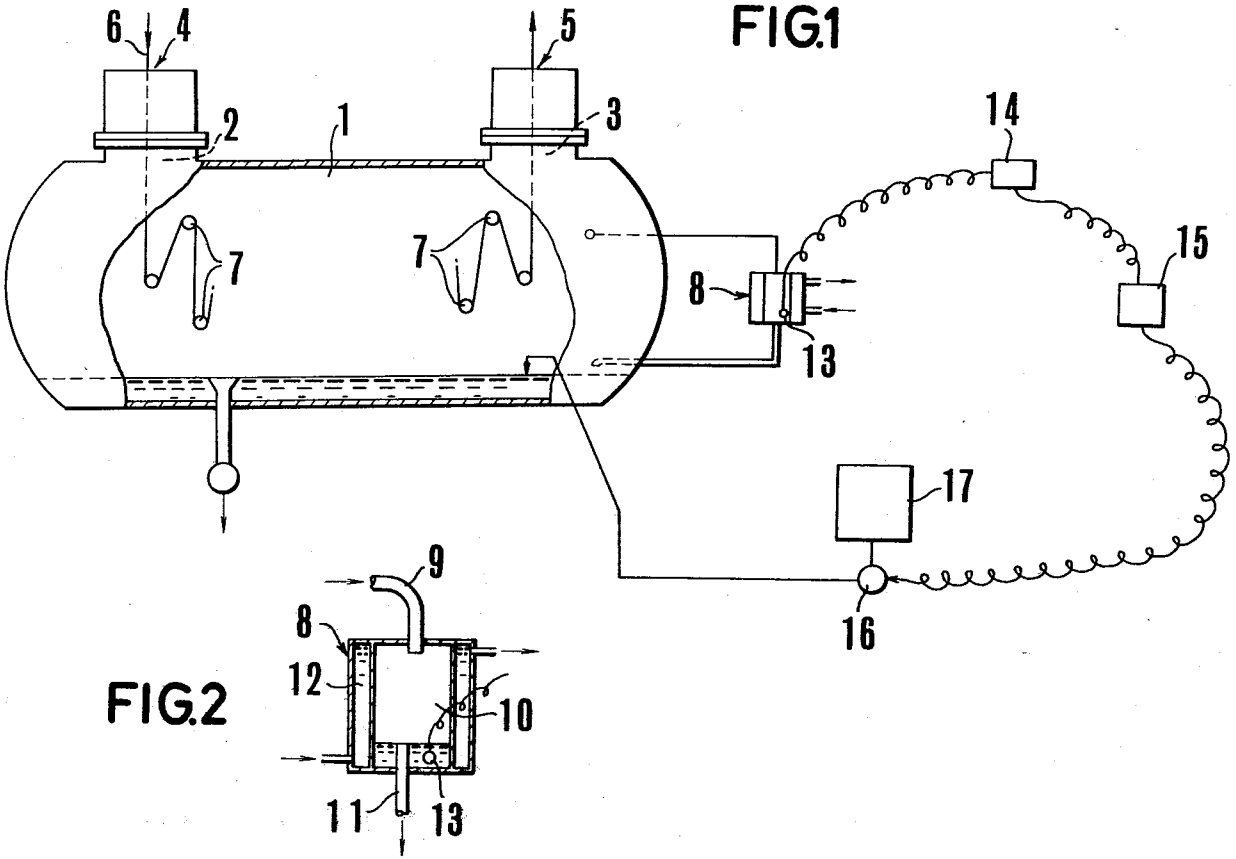
FIG. 1 is the explanatory drawing of an example of the high pressure steamer provided with the present inventive device for measuring and controlling the pH of the atmosphere in the high pressure steamer.
FIG. 2 is an sectional side view of the condensor provided in the steamer body.

Preferred embodiments of the present invention will be described in detail in the following according to the drawings.

In FIG. 1, 1 is a high pressure steamer body for wet heat treating a long cloth continuously. The steamer body 1 is provided with a cloth inlet 2 and a cloth outlet 3, and the cloth inlet 2 and the cloth outlet 3 are provided respectively with an inlet side seal mechanism 4 and an outlet side seal mechanism 5. The seal mechanisms 4 and 5 are provided for the purpose to allow the taking in and out of a cloth to be treated continuously through the steamer body while maintaining the wet heat in the steamer body 1 without leakage. Any one of the seal mechanisms developed by the present applicant can selectively be applied therefor, but since the seal mechanism is without the scope of the present invention, the description of the seal mechanism will be abridged in this place. 6 is a long cloth to be treated, and the cloth 6 is guided successively with a plurality of guide roll 7 to transport the cloth continuously through the steamer body 1 for wet heat treating the cloth at an elevated pressure.

8 is a condenser to condense a part of steam from the steamer body 1 for measuring the pH of the condensed solution, and its details are as shown in FIG. 2. The condenser 8 comprises a steam supply pipe 9 for supplying a part of steam in the steamer body into the condenser, a condense tank 10 for condensing the steam supplied from the steam supply pipe 9, an exhaust pipe 11 for recyling the condensed liquid overflowing from the condense tank 10 into the steamer body 1, a cooling tank 12 surrounding the condense tank 10, and a pH-meter 13 immersed in the condensed liquid at the lower part of the condense tank 10. 14 is an indicator, 15 is a transducer, 16 is a pump or an electromagnetic valve, and 17 is a pH controlling solution tank. The signal from the pH-meter 13 is transferred to the indicator 14 and the transducer 15, the output of the pH-meter is transformed by means of the transducer into electric current or potential to work the pump or electromagnetic valve 16, and a suitable amounts of the pH controlling solution in the pH controlling solution tank 17 is supplied automatically.

The above-mentioned is the construction of a high pressure steamer provided with the present inventive device for measuring and controlling the pH of the atmosphere in the high pressure streamer. Treatment of a long cloth such as pretreatment and dyeing continuously by using this high pressure steamer is done, for instance, as follows.

A long cloth is wet heat treated continuously in the high pressure steamer body 1 maintained with a high temperature atmosphere of steam at an elevated pressure (about 5.5 kg/cm$^2$) while condensing a part of the high pressure steam successively in the condenser 8. Since the outer circumference of the condense tank 10 is provided with the cooling tank 12, the steam condenses very rapidly. It is desirable that the volume of steam condensed in the condense tank 10 is as small as possible for following the pH change of the atmosphere accurately.

pH of the condensed solution in the condense tank 10 is measured with the use of the pH-meter 13, the output signal of the pH-meter is indicated with the use of the indicator 14, and the electromotive force corresponding to the pH measured is transformed with the use of the transducer 15 into electric current or potential. The pump or electromagnetic valve 16 is worked accordingly, and a necessary amount of the pH controlling solution is supplied from the pH controlling solution tank 17 into the interior of the steamer body 1 automatically for neutralizing the steam in the steamer body.

As above described, in the present invention, the change of the steam atmosphere in the steamer body can always be measured successively, and the pH of the atmosphere can be kept constantly neutral automatically. Accordingly, wet heat treatment of a cloth can effectively and eminently be done in the present invention to produce an excellent and uniform product without the danger of damaging the high pressure steamer to be applied.

What is claimed is:

1. A device for measuring and controlling the pH of the atmosphere in a high pressure steamer, comprising a condenser for taking out and condensing a part of steam from the interior of the high pressure steamer body successively, a pH-meter immersed in the solution condensed in the condenser, an indicator and a transducer which are to work in accordance with the signal from the said pH-meter, and a means for controlling the amount of a pH controlling solution to be supplied into the interior of the steamer body in accordance with the output of the said transducer.

* * * * *